US005143039A

United States Patent [19]

Gmelin

[11] Patent Number: 5,143,039

[45] Date of Patent: Sep. 1, 1992

[54] FUEL DISTRIBUTOR FOR THE FUEL INJECTION SYTEMS OF INTERNAL COMBUSTION ENGINES

[75] Inventor: Karl Gmelin, Flein, Fed. Rep. of Germany

[73] Assignee: Robert Bosch GmbH, Stuttgart, Fed. Rep. of Germany

[21] Appl. No.: 634,227

[22] PCT Filed: Mar. 23, 1990

[86] PCT No.: PCT/DE90/00232

§ 371 Date: Jan. 2, 1991

§ 102(e) Date: Jan. 2, 1991

[87] PCT Pub. No.: WO90/13741

PCT Pub. Date: Nov. 15, 1990

[30] Foreign Application Priority Data

May 2, 1989 [DE] Fed. Rep. of Germany ..... 3914487

[51] Int. Cl.[5] ..... F02M 55/02

[52] U.S. Cl. ..... 123/470; 123/456; 123/468

[58] Field of Search ..... 123/456, 463, 472, 470, 123/469, 468; 137/561 A

[56] References Cited

U.S. PATENT DOCUMENTS

| | | | |
|---|---|---|---|
| 3,481,365 | 12/1969 | Keen | 137/561 R |
| 3,736,955 | 6/1972 | Schlessler | 137/561 A |
| 4,395,988 | 8/1983 | Knapp | 123/469 |
| 4,601,275 | 7/1986 | Weinand | 123/456 |
| 4,609,009 | 9/1986 | Tisone | 137/561 A |
| 4,751,904 | 6/1988 | Hudson | 123/456 |
| 4,922,958 | 5/1990 | Lemp | 123/456 |
| 4,955,409 | 9/1990 | Tokuda | 123/456 |

FOREIGN PATENT DOCUMENTS

| | | | |
|---|---|---|---|
| 2416803 | 10/1975 | Fed. Rep. of Germany | 123/468 |
| 3644552 | 7/1988 | Fed. Rep. of Germany | 123/468 |
| 3730571 | 3/1989 | Fed. Rep. of Germany | 123/408 |
| 884865 | 12/1961 | United Kingdom | 137/561 A |

*Primary Examiner*—Carl S. Miller

*Attorney, Agent, or Firm*—Edwin E. Greigg; Ronald E. Griegg

[57] ABSTRACT

A fuel distributor for fuel injection systems of internal combustion engines which has an elongate distributor housing with a plurality of location holes, made at axial intervals, for accomodating in each case one fuel injection valve, and at least one axially extending fuel line, which leads tangentially past the location holes and which communicates with the location holes via openings. Via the openings, the fuel injection valves are surrounded by flowing fuel, this serves for supplying fuel and for cooling the injection valves. To improve the cooling effect, flow restrictors (29) are arranged in the fuel line in association with each location hole, approximately centrally in relation to the opening so that fuel can flow around the fuel injection valves by almost 360°.

6 Claims, 2 Drawing Sheets

FUEL DISTRIBUTOR FOR THE FUEL INJECTION SYTEMS OF INTERNAL COMBUSTION ENGINES

PRIOR ART

Figure 1:
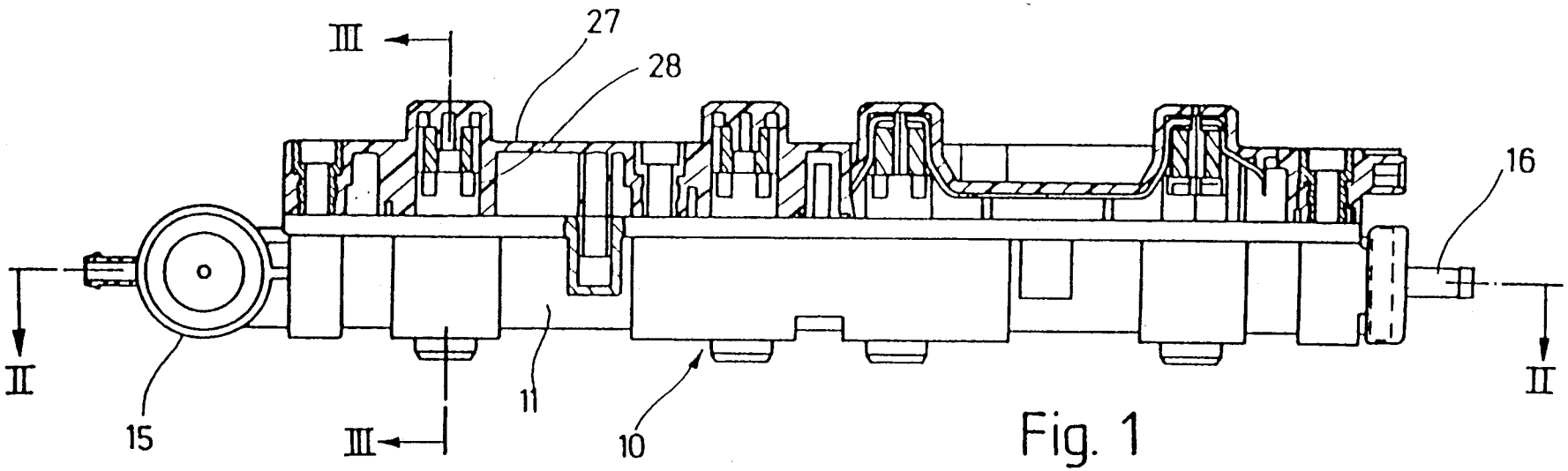

The invention starts from a fuel distributor for fuel injection systems of internal combustion engines of the generic type defined herein.

Such a fuel distributor is described, for example, in DE 37 30 571 A1. By virtue of the fuel-filled annular space surrounding the fuel injection valves, the latter are directly surrounded by fuel and are thereby cooled. The cooling of the fuel injection valves reduces their heat load and thereby improves overall the hot-starting performance of the internal combustion engine.

However, the tangential flow against the fuel injection valves does not allow the full utilization of the cooling capacity of the fuel since complete flow around the fuel injection valves is not achieved

ADVANTAGES OF THE INVENTION

The fuel distributor according to the invention has the advantage that, by virtue of the flow restrictor, assigned to each fuel injection valve, in the fuel line, flow around the fuel injection valves by almost 360° is enforced. The valve housing is thus washed more intenvisely (sic) with fuel over a larger housing area and the cooling effect is thus improved. The improved cooling leads to a lower temperature level in the fuel injection valves during the operating phase of the internal combustion engine, with the result that the maximum temperature in the fuel injection valves which is reached in the shut-off phase of the internal combustion engine is already lower. Due to this lower temperature level, the formation of bubbles in the fuel during the shut-off phase of the internal combustion engine is less. When the internal combustion engine is started in this hot shut-off phase (hot starting), the valve housing is rapidly and intensively cooled on the entire surface and fresh, cool fuel is fed to the valve space. The vapour bubbles in the fuel condense and are in part carried along, with the result that the hot-starting performance of the internal combustion engine is considerably improved.

Advantageous further developments and improvements of the fuel distributor herein are possible by means of the measures presented.

DRAWING

Figure 2:
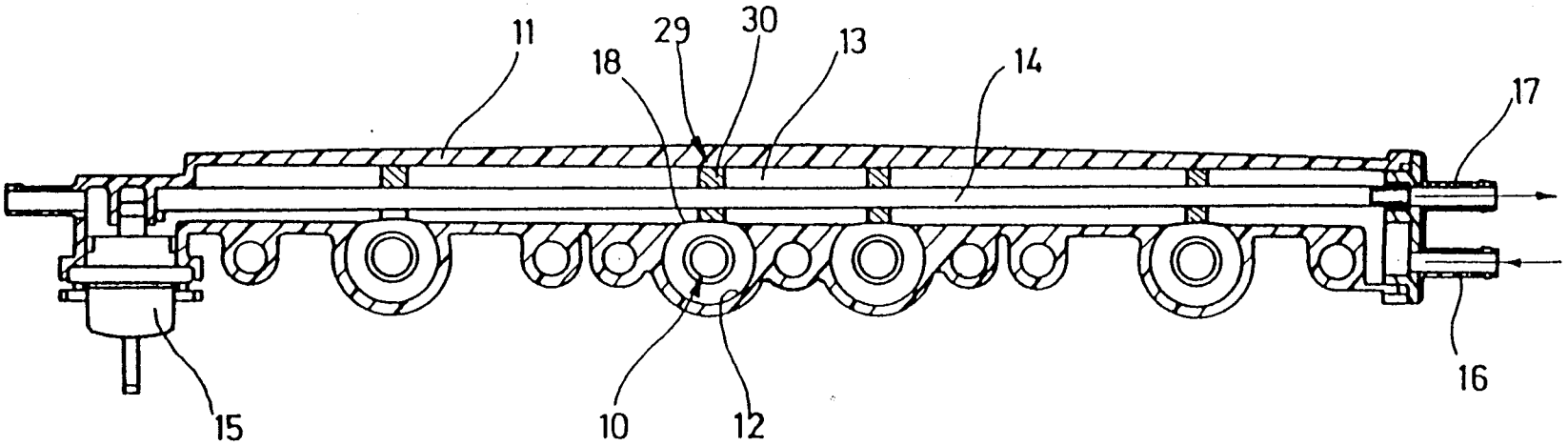
Figure 3:
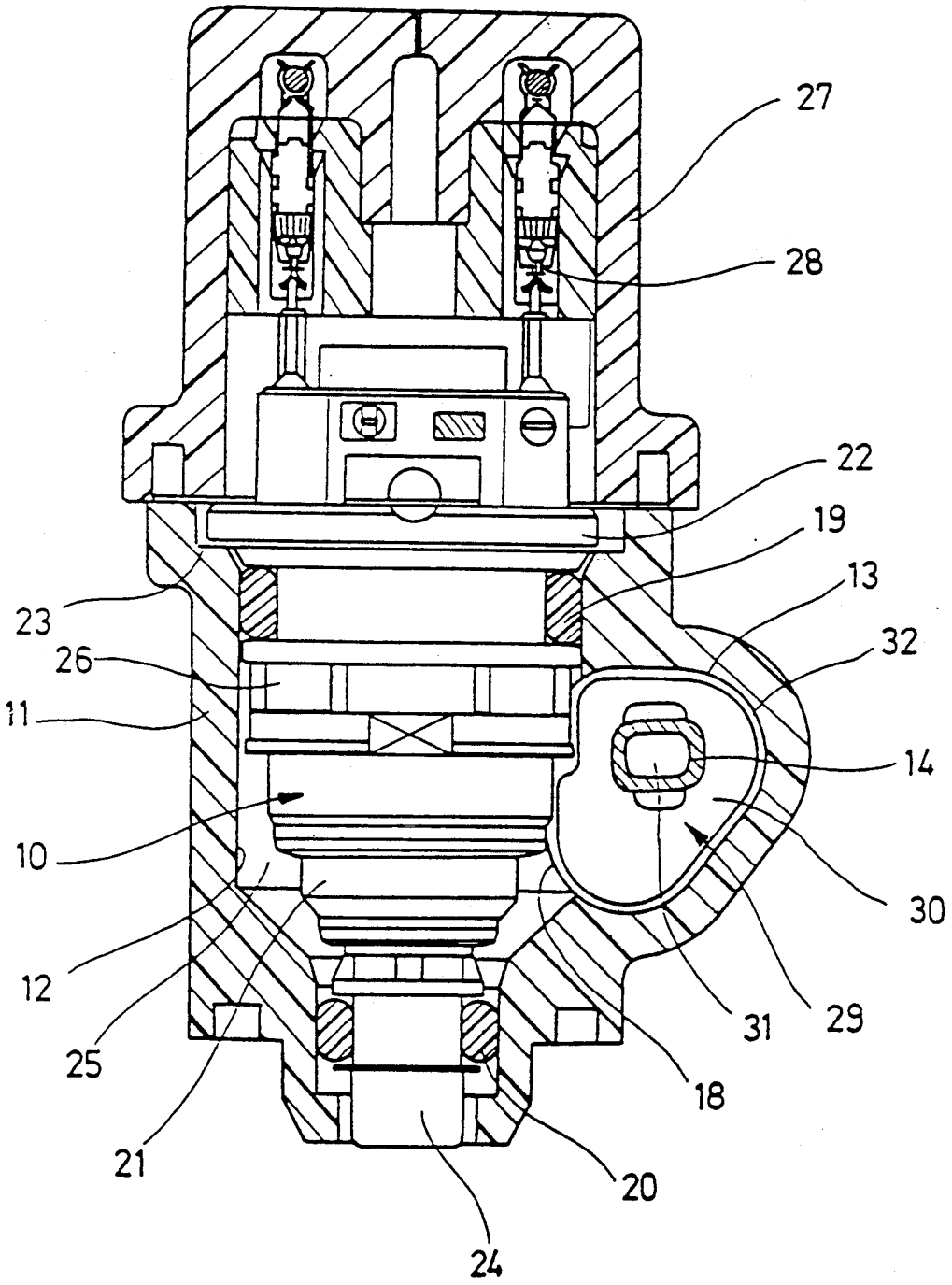

The invention is explained in greater detail in the following description by means of an illustrative embodiment depicted in the drawing, in which:

FIG. 1 shows a side view of a fuel distributor for a fuel injection system of a four-cylinder internal combustion engine, FIG. 2 shows a section along the line II—II in FIG. 1 and FIG. 3 shows a section along the line III—III in FIG. 1 in enlarged representation.

DESCRIPTION OF THE ILLUSTRATIVE EMBODIMENT

The fuel distributor, to be seen in side view in FIG. 1 and in different sectional representations in FIGS. 2 and 3, for a fuel injection system of a four-cylinder internal combustion engine serves for the holding, fuel supply and electrical contacting of four electromagnetically actuated fuel injection valves 10. It has an elongate distributor housing 11 which has four location holes 12 made at axial intervals and two coaxial fuel lines, of which the fuel line of larger diameter serves as a feed line 13 for feeding fuel to the fuel injection valves 10 and the fuel line of smaller diameter extending inside the feed line 13 serves as return line 14 for returning fuel to a fuel tank (not shown). Feed line 13 and return line 14 are connected to one another via a pressure control valve 15 and each connected by their free end to a connecting branch 16 and 17 respectively. The direction of flow of the fuel is denoted by arrows at the connecting branches 16, 17.

The feed line 13 is led tangentially past the location holes 12 and communicates with the location holes 12 via openings 18 penetrating the hole wall and line wall. Inserted fluid-tightly into each location hole 12 is a fuel injection valve 10, this being accomplished by means of two 0 rings 19, 20 (FIG. 3). The valve housing 21, of stepped design, is here supported by an annular flange 22 against an annular shoulder 23 coaxially surrounding the location hole 12 and protrudes from the location hole 12 with an outlet nozzle 24, which bears a fuel ejection opening (not visible) at the front end. The stepping of the valve housing 21 gives rise between the valve housing 21 and the hole wall of the location hole 12 to an annular space 25, which is always full of fuel. From this annular space 25, fuel is fed to a valve space inside the valve housing 21 via a screening element 26. After the insertion of the fuel injection valves 10 into the location holes 12, a contact strip 27 simultaneously serving to fix the fuel injection valves 10 in the location holes 12 and, like the distributor housing 11, consisting of plastic is placed on the distributor housing 11. Arranged in the contact strip 27 are four plugs 28, of which each plug 28 is assigned to one fuel injection valve 10 and serves for its electrical contacting.

To achieve intensive and large-area cooling of the valve housing 21 by the fuel in the feed line 13 flowing past the valve housings 21, flow restrictors 29 are arranged in said feed line 13 in association with each location hole 12, said flow restrictors lying approximately centrally in relation to the opening 18 and hence to the location hole 12 and the valve housing 21 of the fuel injection valve 10. The fuel is forced by these flow restrictors 29 to flow around the associated valve housing 21 by almost 360°. Each flow restrictor 29 is formed by a disc 30 which is aligned transversely to the opening 18 and to the direction of flow in the feed line 13 and leaves open a small annular gap 32 relative to the line wall of the feed line 13. All the discs 30 are secured on the return line 14. For this purpose, as can be seen from FIG. 3, the return line 14 has a cross-sectional profile which deviates from the circular, one dimension of which is larger than the dimension at right angles thereto. In the illustrative embodiment in FIG. 3, this cross-sectional profile is approximately rectangular with rounded corners. Each disc 30 has a central aperture 31, the aperture cross-section of which corresponds approximately to the cross-sectional profile of the return line 14, but has been rotated by 90° relative to the latter. The discs 30, rotated by 90° relative to their final position, are pushed over the return line 14 with their aperture 31 and, in their respective position of association at the individual location holes 12, are rotated by 90° into their final position. The discs 30 thereby jam on the return line 14 and are held there nonpositively.

The invention is not restricted to the illustrative embodiment described. Thus, by reversing the direction of fuel flow, fuel line 14 can assume the function of the feed line and fuel line 13 can assume the function of the return line. For this purpose, connecting branch 16 need only be connected to the fuel tank and connecting branch 17 to the feed pump (likewise not shown) which sucks in the fuel from the fuel tank and delivers it to the fuel injection valves 10.

We claim:

1. A fuel distributor for fuel injection systems of internal combustion engines, having an elongate distributor housing which has a plurality of location holes made at axial intervals in a wall and at least one axially extending fuel line which leads tangentially past the location holes and which communicates with the location holes, in each case one opening penetrating the location hole wall and a fuel line wall, and a plurality of fuel injection valves which are inserted fluid-tightly in one location hole each, an annular space in said location hole surrounding said fuel injection valve, serving for a circulation of fuel, relative to the location holes, a valve space of the fuel injection valves inside a valve housing communicates with the annular space via at least one feedline, each fuel injection valve protrudes in each case with one fuel ejection opening out of the location hole, and flow restrictors (29) are arranged in the fuel line in association with each location hole (12), approximately centrally in relation to the opening (18) which permits fuel to flow into the fuel injection valve and to pass on to the next fuel injection valve in alignment therewith.

2. A fuel distributor according to claim 1, in which each flow restrictor (29) is formed by a disc (30) which is arranged transversely to the opening (18) and to the direction of flow in the at least one axially extending fuel line (13) and leaves open an annular gap (32) relative to the line wall of the at least one axially extending fuel line (13).

3. A fuel distributor according to claim 2, in which said at least one axially extending fuel line includes a first fuel line (13) and a second fuel line (14) that extends inside the first fuel line (13), said first fuel line (13) serving for fuel feel to said fuel injection valves (10) and said second fuel line (14) serving for a fuel return from the fuel injection valves (10), and the discs (30) are secured on the second fuel line (14) within said first fuel line.

4. A fuel distributor according to claim 3, in which the second fuel line (14) has a cross-sectional profile which deviates from a circular form and one dimension of which is larger than a dimension at right angles thereto, and the disc (30) has a central aperture (31) having an aperture profile which is approximately the same but rotated by 90°, with a result that the disc (30) can be pushed onto the second fuel line (14) and, after a 90° rotation, is held nonpositively.

5. A fuel distributor according to claim 3, in which the first and second fuel lines (13, 14) are connected to one another via a pressure control valve (15) arranged in the distributor housing (11) and each fuel line (13, 14) is connected at its free end to a connecting branch (16, 17) projecting from the distributor housing (11).

6. A fuel distributor according to claim 4, in which the first and second fuel lines (13, 14) are connected to one another via a pressure control valve (15) arranged in the distributor housing (11) and each fuel line (13, 14) is connected at its free end to a connecting branch (16, 17) projecting from the distributor housing (11).

* * * * *